US005893703A

United States Patent [19]

Weinrib

[11] Patent Number: 5,893,703

[45] Date of Patent: Apr. 13, 1999

[54] PUMP SHAFT SEALING SYSTEM

[75] Inventor: Harry Peter Weinrib, El Cajon, Calif.

[73] Assignee: Eddy Pump Corporation, Santee, Calif.

[21] Appl. No.: 08/702,055

[22] Filed: Aug. 23, 1996

[51] Int. Cl.[6] ..... F04D 29/08

[52] U.S. Cl. ..... 415/110; 415/113; 415/118; 277/27; 277/35

[58] Field of Search ..... 415/110, 111, 415/112, 113, 118; 277/3, 27, 59, 152, 153, 35

[56] References Cited

U.S. PATENT DOCUMENTS

| | | | |
|---|---|---|---|
| 2,448,717 | 9/1948 | Jeffcock | 415/110 |
| 2,903,970 | 9/1959 | Ellovitz et al. | 415/113 |
| 4,063,743 | 12/1977 | Petros | 277/63 |
| 4,776,753 | 10/1988 | Weinrib | 415/55.1 |
| 4,984,811 | 1/1991 | Kuwabara et al. | 277/59 |
| 5,098,256 | 3/1992 | Smith | 415/111 |

*Primary Examiner*—John T. Kwon
*Attorney, Agent, or Firm*—Fitch, Even, Tabin & Flannery

[57] ABSTRACT

For a pump that produces a negative pressure in a pump casing, a shaft seal system comprises a positive flow of air into the seal system to flow about shaft seals to counteract the negative pressure otherwise being communicated thereto from within the pump casing. The seals engage the rotating shaft and a lubrication passageway supplies lubricant to the shaft seals engaging the rotating shaft, which is driving the rotor. Preferably, no air flows through the seal system when the rotor shaft is stationary and a small air flow, e.g., 0.3 c.f.m. to 1 c.f.m., flows through the shaft seal when the shaft is rotating. This flow rate is preferably monitored.

9 Claims, 3 Drawing Sheets

PUMP SHAFT SEALING SYSTEM

BACKGROUND OF THE INVENTION

This invention relates to a pump shaft sealing system and to a pump having such a shaft sealing system.

There are a large number of different shaft sealing systems used with fluid handling pumps that are very satisfactory for normal operating conditions and for conventional centrifugal pumps. In some situations such on ships, centrifugal pumps are used to pump wastes from toilets, kitchens and various and sundry liquids having caustic or toxic chemicals. Leakage from such pumps presents an especially hazardous situation if the leakage is contained in the pumping compartment in the proximity of the ship's crew by exposing them to infectious and/or contagious diseases, such as hepatitis. Conventional centrifugal pumps on ships may have shaft seal systems that initially leak only a few drops per day. With time, the leakage becomes so pronounced that the constant clean-up of the leaked material and the sterilization of the contaminated area becomes so burdensome, that the leaking system has to be replaced. On most vessels, this replacement process interferes with the normal operation of the ship, since toilets, kitchen sinks and other liquid discharge systems must be shut down during the process. The entire replacement process may take several hours or days. The pump and shaft seal parts are contaminated and must therefore be handled with care so that the ship's crew is not infected during the seal replacement process. Thus, there is a need for a new and improved shaft seal system for pumps used in such or similar environments.

Another difficult environment for pump shaft sealing systems is that of pumping slurries, such as high solid content slurries in mining, dredging or sludge removal. In mining and dredging operations, there are often high concentrations of very fine, sharp and/or hard particles that slide between the rotating shaft and the stationary seal surfaces. To prevent premature wear due to excessive friction, these sealing surfaces must be lubricated. In conventional stuffing boxes, water is often used as a lubricant between a thin copper seal element and the rotating shaft surface. In other systems, grease or some other lubricant is injected into the shaft seal system continuously or at periodic intervals to lubricate the seal surfaces. A common shaft seal ring is made from a VITON™ material, which is a registered trademark of DuPont Industries. The lip of the VITON™ seal ring is urged by springs against the shaft with a predetermined force. Even with lubricant between the VITON™ seal element and the rotating shaft, the friction may cause the seal temperature to rise, and the seal would degrade and fail if it were not of a material capable of operating at high temperatures for long periods of time. Chemicals in the liquid being pumped also can cause material degradation particularly when the seal material is raised to a high elevated temperature. The failure of shaft seal systems can lead to considerable maintenance costs and loss of valuable production time in dredging, mining and other pumping operations. Thus, there is a need for an improved shaft sealing for these kind of pumping operations.

Conventional centrifugal liquid pumps use a net positive suction head in the pump housing to force the liquid to flow through the pump housing outlet. If air is introduced into the pump casing in sufficient quantities, the pressure differential is lost and the pump is said to cavitate in that it no longer is pumping liquid. In centrifugal liquid pumps, the positive pressure in the seal area tends to push liquids and foreign materials, such as particles of dirt or sand along the pump shaft and with possibility into the shaft bearings, thereby damaging the bearings. Another type of pump is called the Eddy Pump and disclosed in U.S. Pat. Nos. 4,596,511 and 4,792,275 (which is a registered trademark of Eddy Pump Corporation of Santee, Calif. The Eddy Pump produces a negative pressure within the pump seal area. This negative pressure is the result of a rotating rotor that forms a rotating liquid nucleus within the housing. The Eddy Pump does not have a closely related rotor and casing, as do centrifugal pumps. The negative pressure in the Eddy Pump will be communicated into and through the shaft seal. There is a need for a new and improved shaft seal system for use with such Eddy Pumps particularly in demanding environmental applications, as discussed herein.

SUMMARY OF THE INVENTION

In accordance with the present invention, there is provided a new and improved shaft seal system that may be substantially leak-proof for a long period of time. This is achieved by introducing a flow of air through the shaft seal elements and into the pump casing. In the Eddy Pump, the positive flow of air counteracts the negative pressure at the seal elements that causes liquid and foreign material to flow from the pump casing along the pump drive shaft. In the preferred operation, there will be no air flow when the pump drive shaft is stationary, but a small air flow through the shaft sealing system occurs when the shaft is rotating. A preferred flow rate is 0.3 c.f.m. up to 1 c.f.m. The air flow rate should be monitored, and an alarm signal generated if the flow rate reaches an excessive level, e.g., 3 c.f.m., indicating that the shaft seals have become worn and less effective.

In the preferred embodiment of the invention, the shaft seal system may be quickly and easily replaced because it is in the form of a cartridge that can readily be removed from the pump. The preferred cartridge includes a shaft wear sleeve that affixes to and rotates with the shaft and is removable as part of the cartridge.

DETAILED DESCRIPTION OF THE PREFERRED EMBODIMENT

Figure 1:
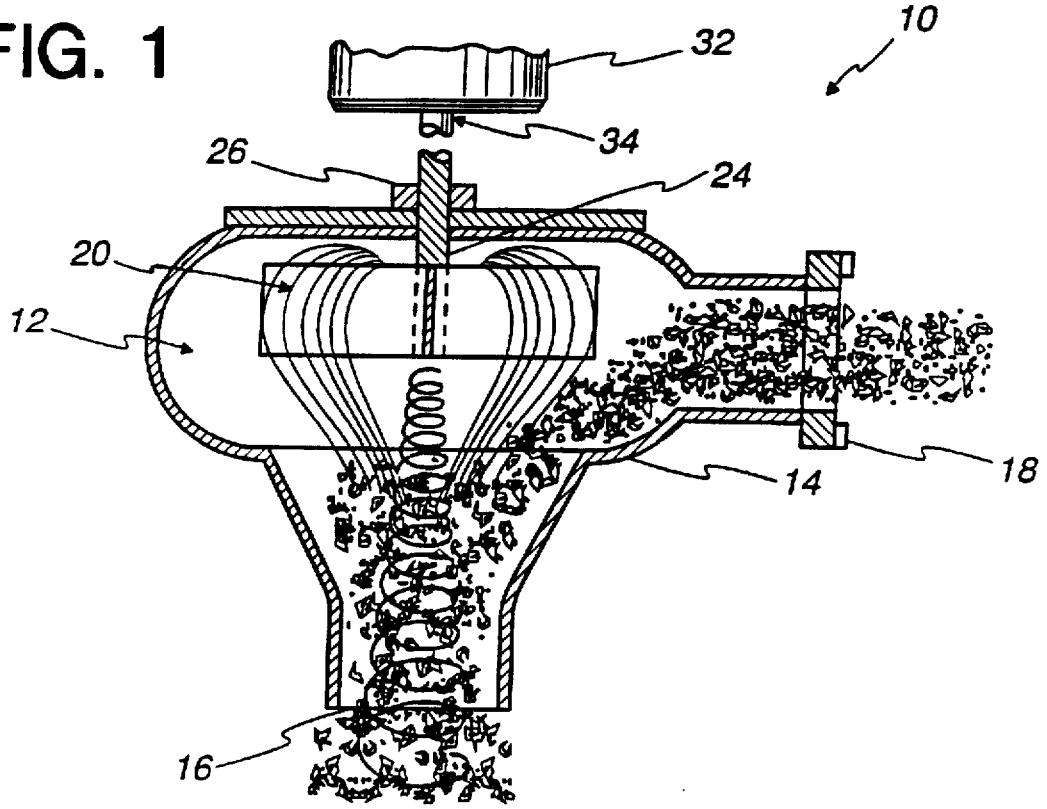
FIG. 1 is a diagrammatic view of a pump apparatus.
Figure 2:
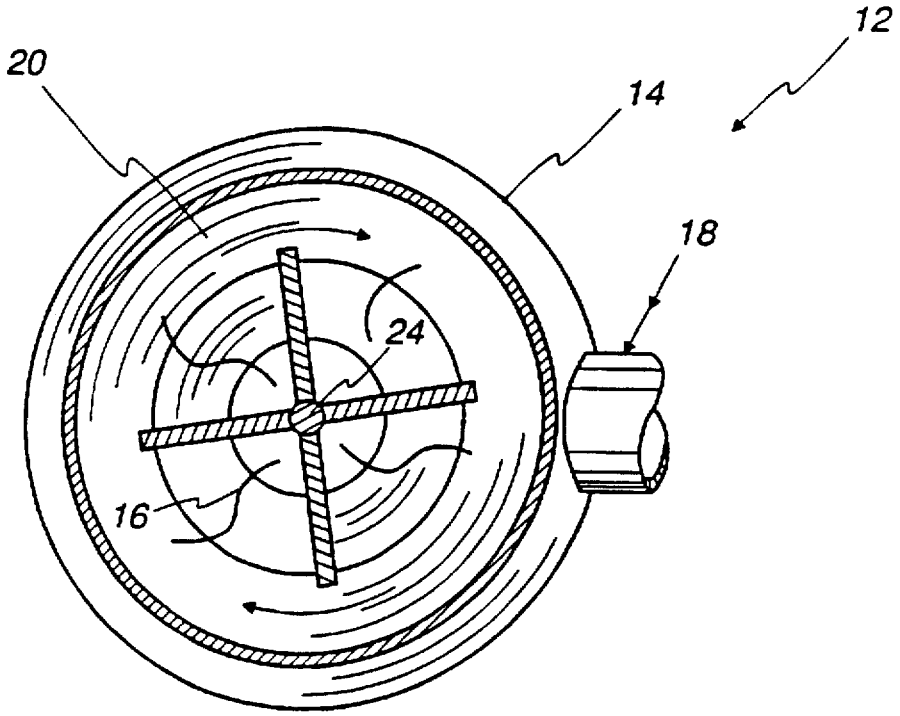
FIG. 2 is a cross-sectional view taken along the line 1—1 of FIG. 1.

As shown in the drawings for purposes of illustration, the invention has embodied a shaft sealing system or apparatus 10 (FIG. 1) for a pump 12 that comprises a pump housing or casing 14 having a pump inlet 16 and a pump outlet 18. Within the pump housing is a chamber 20 containing a rotating impeller or rotor 22. The rotor is affixed to a drive shaft 24 that extends through an opening 26 in the pump casing. The drive shaft is journaled for rotation within a bearing housing 28 which is bolted to the pump casing at one end thereof. A drive means such as a motor 32 has a rotatable output shaft 34 coupled by a shaft coupling device 36 to the drive shaft. Within the bearing housing 28 are radial bearings 40 (FIG. 3) and thrust bearings 42 that locate and permit the drive shaft to rotate. It is desirable that liquid and foreign material, such as dirt or sand, be prevented from traveling along the shaft 24 from the pump casing opening 26 into the bearings to prevent contamination.

The Eddy Pump forms a nucleus 46 of rotating liquid in the pump chamber 20 that produces the pump chamber, i.e., a pressure less than ambient pressure external of the pump casing. When the drive shaft 24 rotates in the bearings 40 and 42, the shaft is able to shift slightly relative to encircling seal elements 50 in the shaft seal system 10 because of the tolerances in the bearings and shaft deflection. In conventional centrifugal pumps, this shifting allows liquid to flow past the seal elements, which may be a very small amount, i.e., only three (3) drops per day initially in the example described above. In these conventional centrifugal pumps, dirt, sand or other foreign material will also travel along the shaft and get between lip seal surfaces 52 on the seal elements 50 and engaged rotating shaft seal surface 54. This foreign material will scratch or wear the lip seal surfaces and/or shaft seal surfaces to cause the leakage flow to increase in volume. In some instances, the progression is very rapid, e.g., in the matter of days, weeks or a few months. Without the present invention, in the Eddy Pump, negative pressure would find its way past the rotating seal elements into spaces 56 on the rear side of the lip seal surfaces and small amounts of liquid and foreign material would flow pass a bushing seal 58 at the pumping casing opening 26 and past each of the seal elements. A negative pressure in front of and behind the lip seals in the Eddy Pump and the positive pressure in the conventional centrifugal pump assists in moving liquid and dirt along the pump shaft causing the seals to leak.

Figure 3:
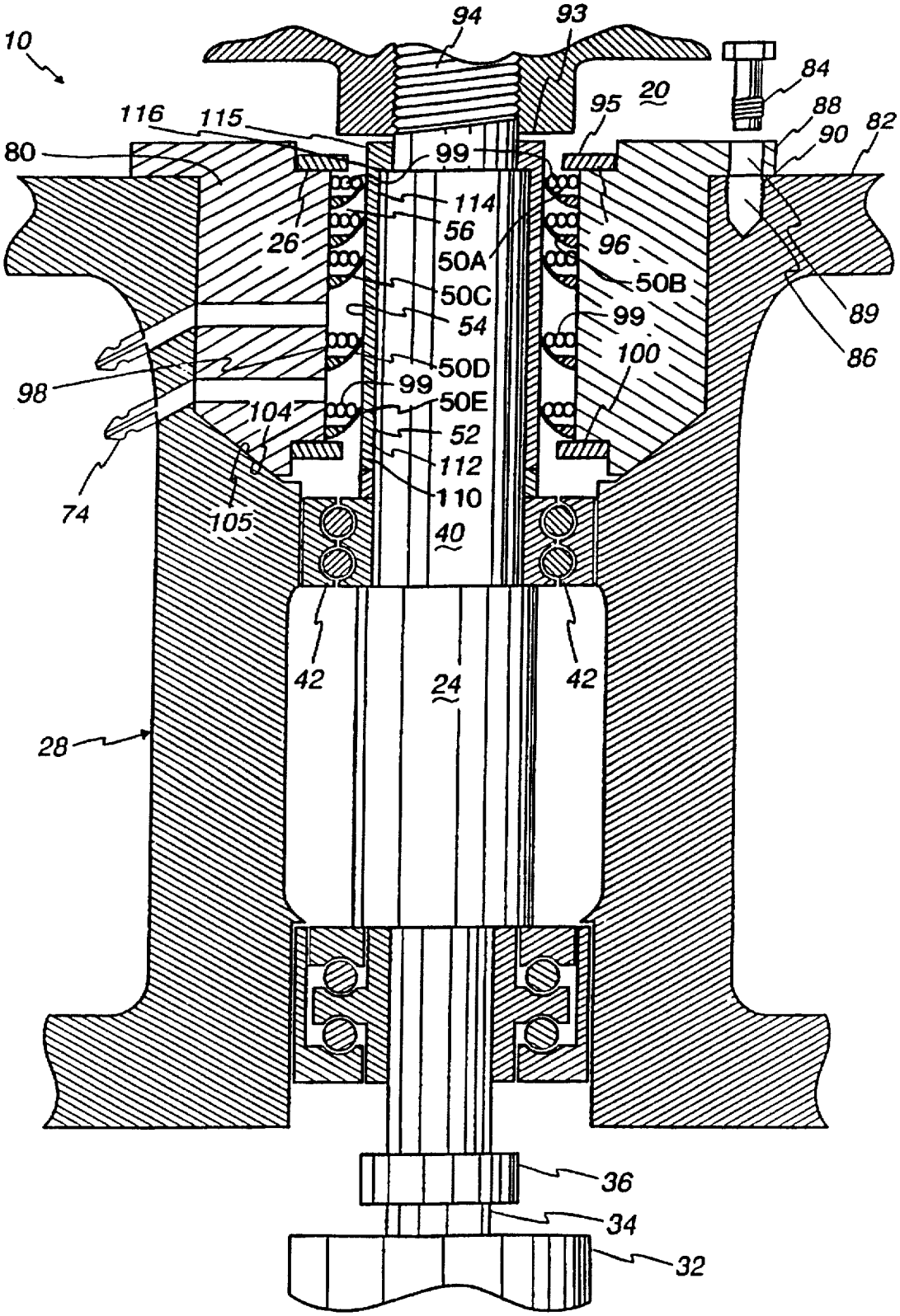
FIG. 3 is an enlarged cross-sectional view of the pumping sealing system which embodies the invention.
Figure 4:
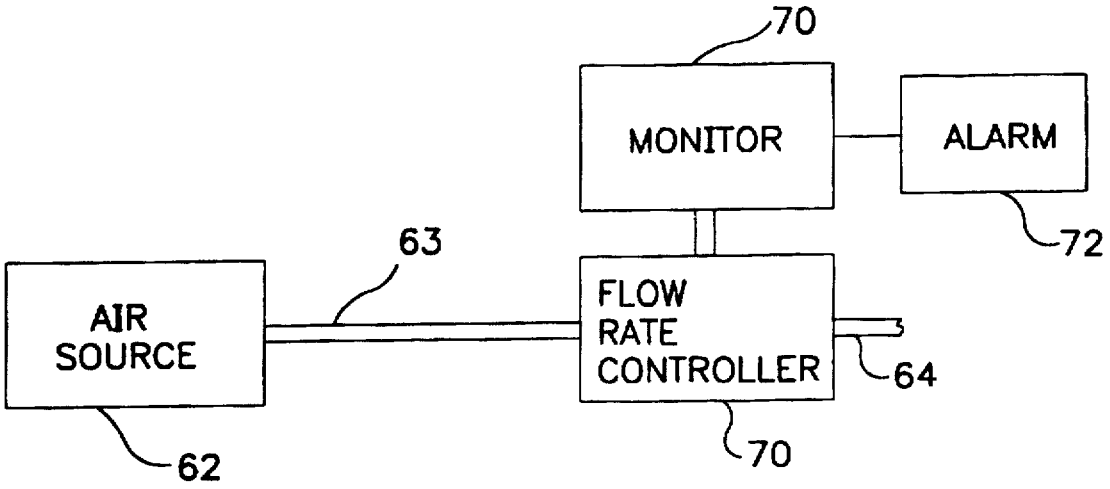
FIG. 4 is a schematic view of the flow rate controller and alarm system.

In accordance with the present invention, such leakage may be reduced to substantially zero by providing a pressurized air flow into the seal cavities to counteract the negative pressure in front of the seal unit. In the preferred embodiment of the invention, pressurized air from an air source 62 is conveyed through a conduit 64 to an air passageway 66 in the bearing housing and into the space between seal elements 50*c* and 50*d* (FIG. 3). The pressurized air flows under the lip and pressurizes the spring side of the seal lip thereby pushing it against the shaft. By way of example only, it has been found that a pressure of 7 to 10 psi is sufficient. In the preferred embodiment of the invention, pressurized air from an air source 62 is conveyed over an air line 63 (FIG. 4) to a flow rate controller 70 which controls or regulates the flow rate of air through the conduit 64, which is connected to air passageway 66 in the bearing. The flow rate controller or valve 70 is adjusted so that there is no flow of air when the shaft is stationary and the lowest rate of flow when the shaft is rotating. This air flow rate will vary from one pump installation to another; but it is usually below one (1) c.f.m. As the shaft seal wears, more air will flow through the seal elements into the pump casing. If the flow rate increases to a predetermined level, for example, 1.5 c.f.m., a monitor 70, which monitors the air flow from the flow rate controller, actuates an alarm 72 to warn that the shaft seal system will need replacement.

Figure 5:
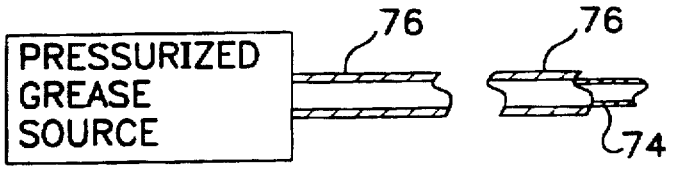
FIG. 5 is a view of the pressurized grease system.

In addition to air, a lubricant such as grease is supplied through a grease passageway 74 to the seal elements to lubricate the shaft seal surface 54 and each of the lip seal surfaces 52. Preferably, the grease passageway 74 is connected by a pipe 76 (FIG. 5) to a pressurized source of grease 78 that continually supplies grease under pressure to the shaft seal system 10.

As shown in the illustration, the preferred shaft sealing system 10 comprises a replaceable cartridge 80 that is bolted to a forward end face wall 82 of the bearing housing 28 by bolts 84 into threaded holes 86 in the end face wall 82. The cartridge is cylindrical in shape with an enlarged end flange 88 that has holes 89 to receive the bolts 84. Suitable O-ring seals 90 are positioned between the flange 88 and the bearing housing end wall to prevent fluid leakage at the interface between the cartridge and bearing housing 28. The bushing seal 58 is a plastic seal ring that abuts against the end wall 93 of the rotor 22. The rotor 22 is threaded on the end 94 of the drive shaft.

Herein, five (5) seal rings 50*a*–50*e* are mounted in a central bore defined by a cylindrical bore wall 98 in the cartridge housing. The preferred seal elements are commercially available conventional seal rings made of VITON™ and having a spring 99 which urges the lip of the seal ring against the shaft seal surface with a predetermined amount of force. The seal elements 50*a*–50*e* are retained in the central bore by a retaining ring 100. The rearward end of the cartridge housing has a sloped, inclined face 104 to abut a similarly inclined face 105 on the bearing housing.

Herein, the cartridge 80 has a central body or housing and is also provided a removable shaft wear sleeve 110 that is a cylindrical sleeve having a bore wall 112 sized in diameter to the cylindrical wall 114 of the drive shaft 24 onto which the sleeve is telescoped. The sleeve has an outer wear surface 54 that is highly finished and sized to mate with the lip seal elements 50*a*–50*e* with the outer sleeve surface functioning as a removable portion of the drive shaft. The sleeve has at its forward end a radially inwardly-projecting flange 115 abutted against a reduced diameter portion of the shaft at an annular shoulder wall 116 on the shaft. A portion (not shown) of the cartridge housing is secured to the sleeve so that the sleeve is pulled from the drive shaft when the cartridge housing is pulled from the bearing housing.

From the foregoing, it will be seen that there is provided a new and more effective sealing system using pressurized air and grease for a pump system used in a highly deleterious environment. The system allows air to flow past the shaft seals and into the rotary pump chamber, which creates a negative pressure in the absence of the pressurized air.

What is claimed is:

1. A pump apparatus for liquids driven by an exterior motor and having a substantially leak-proof operation comprising:

a pump casing having a chamber wall defining an interior chamber for receiving liquid therein and having a liquid inlet for liquid flow into the chamber and a liquid outlet for liquid flow from the chamber;

a rotor rotatably mounted for rotation in the pump casing to force liquid to flow inward through the casing inlet and discharge through the casing outlet;

a rotor drive shaft connected to the motor and extending through an opening in the casing to the rotor to rotate the rotor within the casing to pump the liquid;

a shaft seal having a plurality of seal members encircling the drive shaft and engaging the drive shaft's circumferential surface to prevent leakage of the liquid from flowing outwardly from the pump casing and past the seal;

the rotor being spaced substantially from the casing chamber wall for generating a nucleus of swirling liquid in the chamber and a negative pressure in the chamber to the shaft seal when the pump is operating in the absence of the pressurized air flow to the shaft seal;

a lubricant passageway for applying lubricant to the shaft adjacent the seal members; and a pressurized air passageway to the shaft seals receiving air under a predetermined pressure for flow past the shaft seal and into the pump chamber with the pressurized air flow counteracting the negative pressure from the pump chamber and blocking liquid flow along the shaft and past the shaft seal so that the pump operations in a leak-proof manner.

2. A pump apparatus in accordance with claim 1 wherein the pump seal comprises a plurality of spaced seal members encircling and engaging the shaft; and the air passageway is disposed between spaced seal members for pressurized air to flow both in opposite directions toward the motor and the pump casing.

3. A pump apparatus in accordance with claim 2 wherein one of the spaced seal members have bent, curved lips engaging the shaft and pointed toward the pump casing with the shaft deflecting the curved lips radially outwardly; and pressurized air in the air passageway flowing along the shaft toward the motor is applied to the outer side of the bent seal member to urge it more tightly against the shaft, and the pressurized air engaging the other seal member closed to the pump casing urges said seal member away from the shaft.

4. An apparatus in accordance with claim 1 wherein the lubricant passageway is a grease lubrication passageway in the seal for receiving grease lubricant to supply a grease lubricant to the shaft seal members at their respective interfaces with the rotating shaft surfaces.

5. A pump apparatus in accordance with claim 2 wherein the flow rate of pressurized air through the seal member is less than 3 c.f.m.

6. A pump apparatus in accordance with claim 2 wherein a sensing means senses the air flow rate through the air passageway; and an alarm is actuated by the sensing means when the flow rate exceeds a predetermined rate of flow.

7. A pump apparatus in accordance with claim 2 wherein the air flow rate is initially about 0.3 c.f.m.

8. A pump apparatus in accordance with claim 2 wherein the pump seal comprises a removable cartridge having a plurality of seal members and the air passageway therein.

9. A pump apparatus in accordance with claim 8 wherein the pump cartridge has a removable wear sleeve fixed to the shaft to rotate therewith; and the stationary seal members encircle and engage the removable wear sleeve to seal therewith.

* * * * *